United States Patent [19]

Bruyndonckx et al.

[11] Patent Number: 4,519,696

[45] Date of Patent: May 28, 1985

[54] XEROGRAPHIC COPYING APPARATUS

[75] Inventors: Jan J. Bruyndonckx, Hove; Jacobus H. Bosschaerts, Mortsel, both of Belgium

[73] Assignee: AGFA-Gevaert N. V., Mortsel, Belgium

[21] Appl. No.: 465,286

[22] Filed: Feb. 9, 1983

[30] Foreign Application Priority Data

Feb. 11, 1982 [GB] United Kingdom ..... 8204033

[51] Int. Cl.[3] ..... G03G 15/00

[52] U.S. Cl. ..... 355/14 D; 118/689; 118/690; 324/204

[58] Field of Search ..... 222/56, DIG. 1; 118/689, 688, 690; 355/14 D; 324/204

[56] References Cited

U.S. PATENT DOCUMENTS

| | | | |
|---|---|---|---|
| 3,698,926 | 10/1972 | Furuichi | 118/689 X |
| 3,999,687 | 12/1976 | Baer et al. | 118/689 X |
| 4,195,260 | 3/1980 | Sakamoto et al. | 118/689 X |
| 4,321,886 | 3/1982 | Azuma | 118/689 |

*Primary Examiner*—Ulysses Weldon

*Attorney, Agent, or Firm*—William J. Daniel

[57] ABSTRACT

A xerographic copying apparatus including a device for monitoring the concentration of toner in a xerographic developer mixture of ferromagnetic particles and non-ferromagnetic toner, said device comprising a measuring induction coil that is mounted close to the developer supply so that its magnetic field traverses a portion of the mass of the developer, and a reference induction coil that is mounted close to the measuring coil, but with its magnetic field prevented from traversing the developer mixture, and suitably closely on a wall of the hopper for the toner supply.

7 Claims, 5 Drawing Figures

Figure 1:
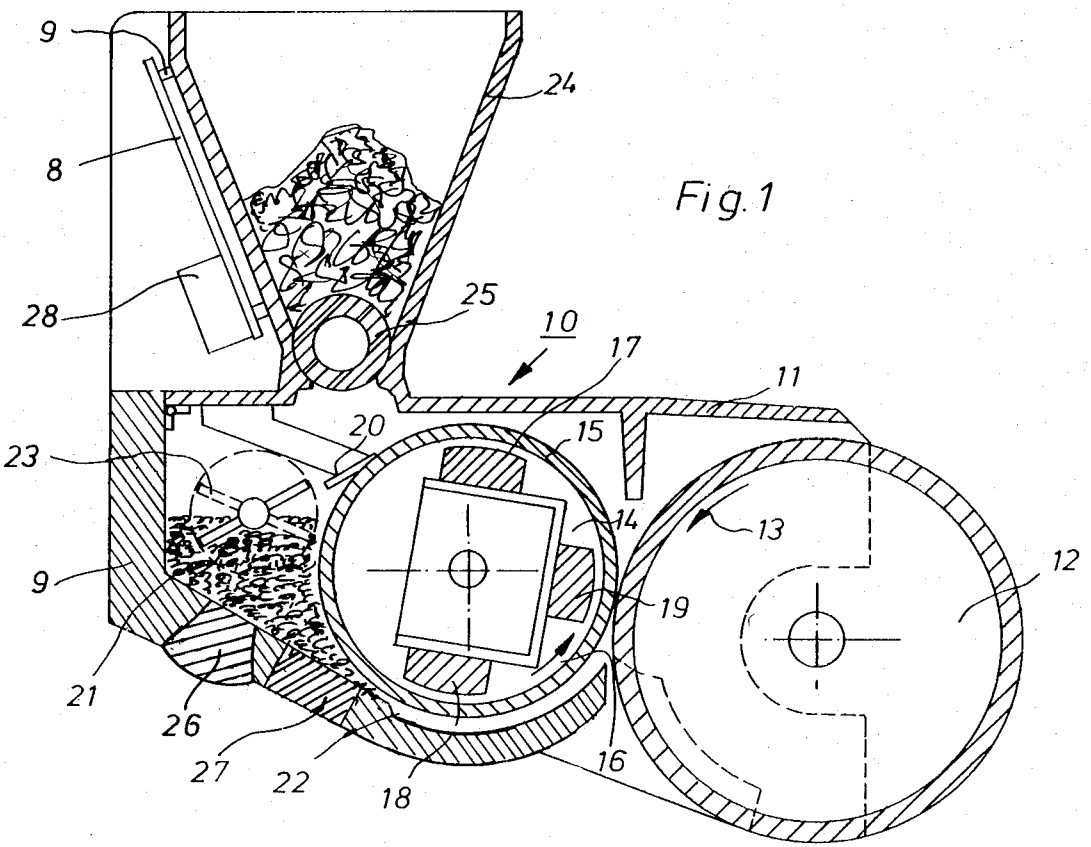

9
8
28
23
9
21
26
27
22
18
20
25
24
10
17
15
14
19
16
13
11
12

XEROGRAPHIC COPYING APPARATUS

This invention is concerned with a device for monitoring the concentration of toner in a toner/carrier mixture as used in a xerographic copying apparatus. More particularly, the device is concerned with the monitoring of the toner concentration in a toner/carrier mixture suited for so-called magnetic brush development.

In magnetic brush development, a toner/carrier mixture (hereinafter referred to as developer) is applied to the surface of an exposed photoconductor in order to render the latent electrostatic image thereon visible. Such a developer consists of magnetically attractable carrier particles, such as iron filings, mixed with non-magnetic toner powder. Due to friction between the carrier particles and the toner powder, the latter is triboelectrically charged. The polarity of this acquired charge is opposite to the polarity of the electrostatic latent image on the photconductor so that, due to Coulomb forces, the toner powder is attracted by the charge of the latent image, thereby rendering the latter visible. Subsequently, a transfer and/or a fixing process is carried out. During the fixing process, resinous compounds, which are present in the toner powder are at least partially brought to molten state, so that after solidification, a permanent bond is established between the toner powder and the photoconductor, or between the toner and the support to which it was transferred. The carrier particles which are supplied to the photoconductor as well as the surplus toner powder supplied thereto are recycled to the developer reservoir. It follows therefore that the concentration of toner powder in the developer in the reservoir gradually decreases during a succession of developing cycles unless compensating measures are taken.

Some prior art xerographic copying apparatus include toner supply devices which, during each copying cycle or after a predetermined number of copying cycles, supply a preset amount of toner powder to the toner/carrier mixture in the reservoir. This preset amount depends on the nature of the originals which are generally copied. When copying low density originals the amount of toner to be supplied is of course smaller than when copying so-called dense originals.

It will be evident that if there is a substantial variation in the nature of the originals being copied, the unvaried dosing of toner powder to regenerate the toner/carrier mixture is liable to cause over- or under-regeneration.

In order to prevent the unwanted effects above referred to, it is known to use automatic toner replenishing systems which control the concentration of toner in the developer mixture, in the reservoir with the view to keeping this concentration substantially constant even if originals of varying density are copied.

In xerographic techniques, using magnetic brush development, it is known to control the toner concentration in dependence on variations in the coefficient of self-induction of an induction coil as a consequence of variations in the iron carrier/toner ratio in the developing mixture located in the vicinity of the coil. The variations in the coefficient of self-induction is used either to detune an oscillator or to increase or decrease the magnitude of the AC-voltage across the terminals of a self inductance fed by an AC source.

For example, U.S. Pat. No. 3,572,551 describes and claims a toner concentration minotoring device in which use is made of a kind of by-pass tube, around which a self-induction coil is provided and through which an amount of developer flows. After the monitoring stage, the sampled portion of the developer is fed to the developer reservoir again. The self-induction coil is a frequency determining element of an oscillator and the oscillator produces a signal with characteristics depending on the amount of iron particles in the induction coil. A variation of the toner concentration, which entails a variation of the iron content per unit of volume of developer, changes the amplitude of the AC-signal generated by the oscillator. This change can be detected by a conventional amplitude detecting circuit. If the selectivity curve of the resonant circuit is sufficiently steep, relatively large signal variations are generated for small fluctuations of the toner concentration. Variations from a set point, corresponding with a normal toner concentration, can accordingly be accurately detected and used to energize a toner supply system when the toner concentration becomes too low or to stop the toner supply system when the toner concentration reaches a predetermined maximum. Although such a system is theoretically viable it has in practice certain disadvantages. External, environmental factors can detune the oscillator. Moreover it is questionable whether a representative sample of developer mixture flows through the tube bearing the coil. Another drawback of the system lies in the rather long time delay which may occur between the developing and the sampling step.

In German Patent Specification No. 2,055,321 another toner concentration monitoring apparatus is disclosed which makes use of a sampling coil provided around a tube through which developer flows immediately after the developing process. The signal generated by the AC-circuit comprising the sampling coil is compared with a reference signal and the difference between these signals is used as a control signal for a toner replenishing system. Also in this system, no account is taken of external parameters influencing the response of the self-induction coil. This disadvantage is also possessed by the analogous method described in the German Printed Application No. 27 18 978. In this disclosure the frequency of an oscillator containing the sampling coil is compared with the frequency of a reference oscillator. The beat-frequency obtained after comparison is rectified and used as control signal for a toner supply system.

The present invention aims to provide a toner concentration monitoring apparatus which while utilising the self-induction of a sampling coil as a measure of toner concentration, yields monitoring signals which are not affected by environmental factors such as the heat generated in the interior of a copying apparatus as a consequence of the presence of light sources, heat fixing stations and electrical components.

According to the invention, there is provided a xerographic copying apparatus including a device for monitoring the concentration of toner in a xerographic developer composed of a mixture of ferromagnetic particles and non-ferromagnetic toner, which device comprising an induction measuring coil that is mounted close to the developer supply so that its magnetic field traverses a portion of the mass of developer, a second induction coil mounted close to the developer supply so that its magnetic field does not traverse the developer mass, but exposed to the same environmental temperature conditions as the first coil, an AC bridge circuit in which the first and said second coils are present in a first and a second arm of the circuit, an AC source for feeding said bridge circuit, and detecting means for detecting and signalling relative variations in the AC voltages across said first and second induction coils.

It is a simple matter to ensure that the balance of the bridge circuit is only affected by the toner concentration in the flow passage for the developer. It suffices to locate the induction coils of the bridge circuit so that they are always exposed to substantially the same environmental influences, in particular environmental temperature which affects self-induction coefficients.

The apparatus according to the invention yields more reliable monitoring signals because of the automatic compensation for ambient factors. Moreover, because of the adoption of a bridge circuit the design of other components of the monitoring apparatus is less critical. For example, the frequency of the AC-generator feeding this circuit need not be stabilized because variations in the impedance caused by any frequency fluctuations will be equal for the two coils.

In a preferred embodiment, the two self-induction coils are identical.

In order to ensure that the second self-induction coil is a true reference it should be mounted at a predetermined distance from metallic parts of the apparatus in which it is mounted. Alternatively this coil may be short-circuited by means of e.g. a small body made of a dispersion of magnetisable material in an epoxy resin.

It is of course necessary for the volume of developer affecting the self-inductance of the first induction coil to be kept constant, at a value on the basis of which the monitoring apparatus is set up or calibrated prior to its use. There is no problem in fulfilling this requirement. The flow path along which the developer flows through the monitoring zone can be defined, as is conventional in xerographic copying machines, by a passageway along which the developer flows from a reservoir to the photoconductor bearing the latent image to be developed or to the magnetic brush (if need be). Provided that that passageway is kept filled with developer the quantity of developer influencing the self-inductance coefficient of the monitoring coil will be constant, regardless of the volume rate of flow of developer through the passage.

The monitoring apparatus may comprise differential amplifier means which after rectification generates a DC-voltage the magnitude of which is directly proportional to variations in the self-induction coefficient of the monitoring coil relative to that of the reference coil. The varying DC-voltage can be applied to a Schmitt-trigger circuit which itself delivers a signal when the applied DC-voltage exceeds a predetermined value. The output of the Schmitt-trigger circuit can be used to energize a LED display or it may be applied to a power amplifying station which itself controls a solenoid or other energizable device which controls the operation of a toner dispensing mechanism.

As already mentioned hereinbefore, the frequency of the AC-generating means for feeding the bridge circuit is not critical. In a particular embodiment of the invention, this frequency is 3.3 kHz.

Figure 2:
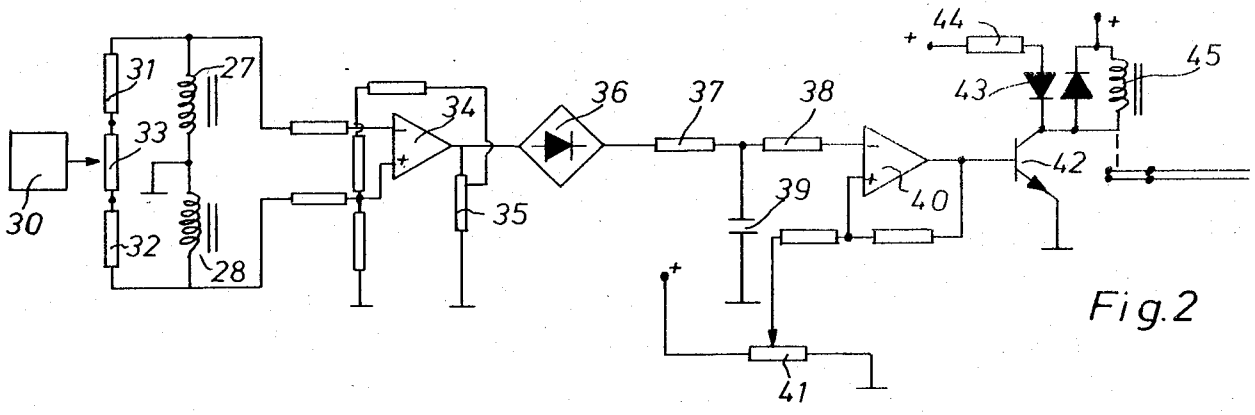
Figure 3:
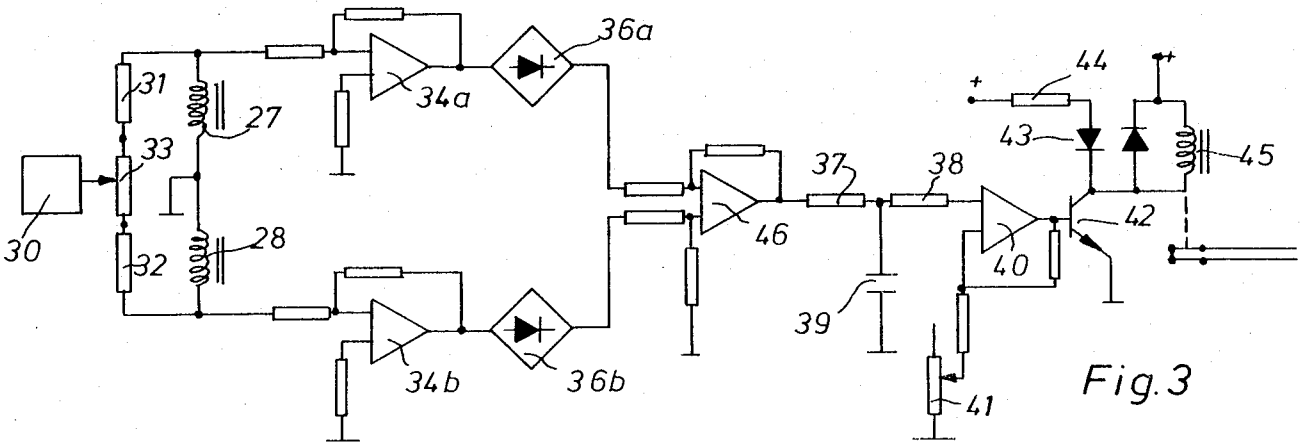
Figure 5:
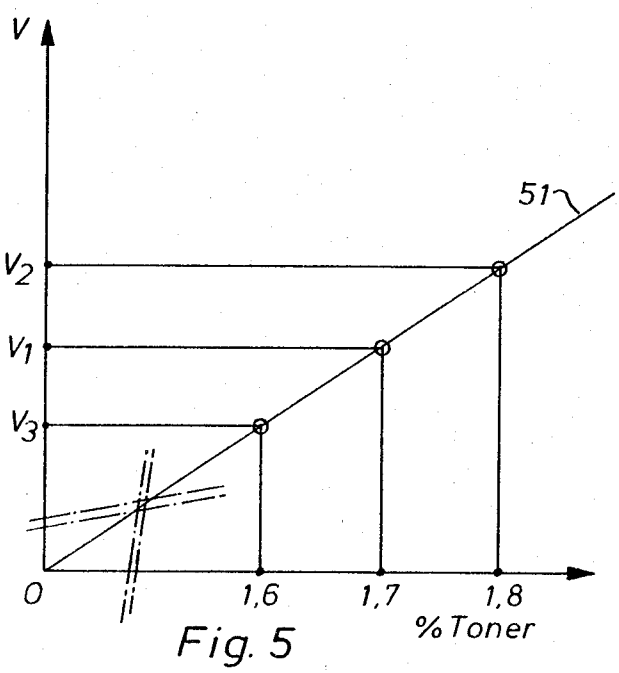
Figure 4:
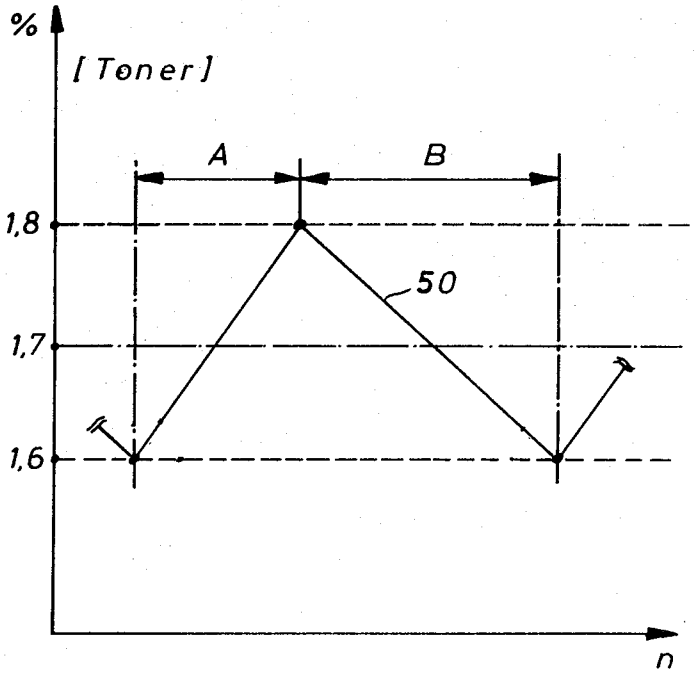

An embodiment of the invention selected by way of example will now be described with reference to the accompanying drawings in which:

FIG. 1 is a cross-sectional view of a magnetic brush development station of a xerographic copying unit, associated with a toner monitoring device according to the invention, FIGS. 2 and 3 show the electronic circuitry suitable for this apparatus in two alternative forms, FIG. 4 is a graph illustrating the cyclic nature of the toner replenishment which occurs in a commercial xerographic copier incorporating such a monitoring apparatus for controlling an associated toner replenishing device, and FIG. 5 shows the relationship between the toner concentration and the DC-voltage generated by the toner monitoring apparatus.

Referring to FIG. 1, a magnetic brush development station 10 comprises a frame 11 for mounting a xerographic drum 12 which rotates in the sense of the arrow 13 and which bears an electrostatic latent image to be developed.

This development is carried out with the help of a coloured powder, known as a toner, which, prior to be applied to the surface of xerographic drum 12, is charged by tribo-electricity. The tribo-electric charge is conferred on the toner particles by friction against so-called carrier particles which together with the toner powder constitute the developer mixture. By adequate choice of the materials constituting the toner and the carrier, the tribo-electric charge conferred to the toner particles is of a polarity opposite to that of the electrostatic latent image. As a consequence, toner particles will be attracted by the charge of the latent image, so that the latter becomes visible.

In case of magnetic brush development, the carrier particles are in the form of iron fillings or other magnetisable material. The magnetic developing brush 14, is composed of a hollow cylinder 15, rotating in the sense of arrow 16 in which a plurality of axially extending permanent magnets 17, 18, 19 are arranged. Due to the magnetic force, emanating from the permanent magnets 17, 18, 19, toner/carrier mixture is attracted to the peripheral surface of cylinder 15. Upon rotating this cylinder, toner and carrier particles are transported along the surface of the latent image bearing xerographic drum 12 and as toner particles are attracted thereby they render the latent image visible. The carrier and non-used toner particles are removed from cylinder 15 with the help of a scraper 20 and fall down into a developer reservoir 21 which is bounded by the lower left quadrant of the roller 15 and the tray 9 made of a rigid material such as aluminium or the like. Edge 22 formed on the upper surface of the tray 9 ensures a uniformly and reproducibly thick layer of developer mixture carried off by the surface of cylinder 15.

In order to maintain a uniform distribution of toner in the developer mixture, a so-called cross-mix element 23 is provided. The cross-mix element 23 rotates in the reservoir 21 of the development station and mixes recycled developer collected by scraper 20 and toner dispensed from toner supply hopper 24, with the developer mixture already present in the reservoir 21. Toner discharge from hopper 24 is controlled by a metering roller 25 which is driven by motor means (not shown). The surface profile of roller 25 is such that upon its rotation a small quantity of toner powder is released into the reservoir 21.

To enable the emptying of the reservoir 21, e.g. for the purpose of changing the carrier particles, an opening that may be sealed by a plug 26 is provided in the tray 9.

In close proximity to the development station there are self-induction coils 27 and 28, forming part of the toner concentration monitoring device according to the invention.

The self-induction coil 27 (hereinafter referred to as monitoring or measuring coil) is located near the edge 22 so that the developer flowing over this coil is a representative sample used in the developing cycle. The coil is mounted in a corresponding opening in the tray and is so disposed that its upper face lies flush with the inner surface of the tray 9, so that no stagnation is caused for the developer mixture. The monitoring coil 27 preferably has an E-shaped cross-section, the legs of which are so oriented that at least some of the magnetic lines of force which would be produced if the monitoring coil 27 would be energized with an AC-voltage, would pass through the developer mixture flowing along the feed path leading out of the reservoir 21. So, a closed loop configuration of magnetic lines of force, is created by the core of the monitoring coil 27 and the magnetisable material (in this case iron filings) present in the developer mixture. The monitoring coil therefore has a certain self-inductance during operation of the apparatus.

Because during development, a certain amount of toner powder is consumed whereas substantially all of the carrier particles are recycled, the amount of iron filings per unit of volume developer in the reservoir gradually increases in the course of xerographic copying cycles. The increase of the iron content in the developer mixture flowing over the monitoring coil 27 results in a variation of the attributed self-inductance of that coil. The variation of this self-inductance may be considered as a measure of the toner consumption provided other influential factors are equal.

In contrast with prior art monitoring systems the monitoring coil is incorporated in a bridge circuit which also includes a second self-induction coil 28 (hereinafter referred to as a reference coil).

The reference coil 28 is mounted in such a way that the magnetic lines of force it generates are prevented from passing through the developer mixture. This effect is obtained by mounting reference coil 28 at a sufficiently large distance from the space where developer is present, or, alternatively, by permanently short-circuiting it with the help of a body comprising magnetisable material e.g. dispersed in an epoxy resin.

In the present example, the reference coil 28 is mounted on a printed circuit board 8 that is mounted with screws and spacing collars 7 closely parallel against a wall of the hopper 24 containing the toner composition.

The printed circuit board 8 may suitably comprise all the components of the electronic circuit of the toner concentration monitoring device that will hereinafter be described.

As the reference coil is not influenced by the magnetisable material in the developer, its self-inductance is not affected by the varying amount of magnetisable material in the developer mixture. On the other hand, the coil 28 is near to coil 27 and in any event will be exposed to the same environmental influences as coil 27 so that changes in the self-inductance due to these factors will be equal for the two coils.

In FIGS. 2 and 3 are presented different electronic circuits for the toner concentration monitoring device.

In FIG. 2, an oscillator 30 produces an AC-voltage of about 12 volts p.p. at a frequency of 3.3 kHz which is applied to a bridge circuit comprising the monitoring coil 27, reference coil 28, resistors 31, 32 and potentiometer 33. The potentiometer 33 is used for balancing the bridge circuit, e.g. during the calibration, resulting in predetermined voltage drops across the coils 27 and 28 which voltage drops must be equal when there is a certain predetermined amount of carrier particles in the field of the monitoring coil 27. The frequency of the AC-voltage produced by oscillator 30 is not critical because the monitoring and reference coils 27, 28 form an impedance which for both elements is in direct proportion with said frequency and variations of the latter are automatically compensated.

On the other hand the amplitude of the AC-voltage applied to the bridge circuit must be very stable because it constitutes the characteristic parameter which is a measure of variations in toner concentration. In a preferred embodiment, the oscillator 30 is composed of a square wave generator of constant amplitude provided with a built-in T-filter and an operational amplifier in its feed-back circuit. The operational amplifier and associated T-filter may be considered as the analogue of a tuned circuit. In order to guarantee a constant amplitude, the power supply of the oscillator 30 is voltage-stabilized.

The AC-voltages across the induction coils 27 and 28 are applied to differential amplifier stage 34 which compares the magnitude of these voltages and which generates an output signal if the bridge circuit becomes unbalanced. A potentiometer 35 is provided in the feed-back circuit of the amplifier stage 34 to control its sensitivity.

The output of the differential amplifier stage 34 is applied to a detecting circuit 36 which is of the single-phase type and which produces a varying DC-voltage at its output which is directly proportional to the unbalance of the bridge circuit.

Prior to being applied to a trigger circuit, the varying DC-voltage of the detecting circuit 36 is passed through a further T-filter comprising resistors 37 and 38 and capacitor 39 in order to ground occasional high-frequency components which might be present in the DC-signal.

The trigger circuit 40 is a conventional type and is provided with means for adjusting the trigger-point, in the form of potentiometer 41. In so doing, the toner concentration, and consequently the density of the copies to be made, may be adjusted. The so-called hysteresis of the trigger circuit is fixed which means that the difference between the maximum and minimum DC-voltage levels at which the trigger circuit is set to operate is constant. At maximum level the trigger circuit 40 produces no output signal, whereas at minimum level a monitoring signal is generated.

The signal, if any, of the trigger circuit 40 is applied to an amplifier stage 42, the load of which comprises a LED (light emitting diode) 43 and associated resistor 44. In case an output signal is generated by the trigger circuit 40, the LED 43 lightens up, so indicating that the toner concentration has fallen below a pre-set minimum value.

The output signal of the amplifier stage 42 may be used to energize a relay 45 for controlling a motor driven toner replenishing device of conventional design, e.g., metering roller 25. Such toner replenishing mechanisms are sufficiently known by those skilled in the art and need therefore no further description. The relay 45 may alternatively be driven via a microprocessor (not shown) to which the output signal of the amplifying stage 42 is applied.

Instead of being directly connected to the trigger circuit 40, the amplifying stage 42 may be coupled thereto through an opto-electric coupling device, known in the art.

In FIG. 3 a circuitry more or less analogous to the one shown in FIG. 2 is illustrated. The main difference between these two circuitries resides in the fact that the amplifying stage 34 of FIG. 2 is split into two separate amplifiers 34*a* and 34*b* with associated rectifiers 36*a* and 36*b* and that an additional amplifier 46 is provided prior to the application of the varying DC-signal to the trigger circuit 40.

FIG. 4 is a graph illustrating the cyclic nature of the toner replenishing process which occurs in a commercial xerographic copying apparatus incorporating a toner monitoring device according to the invention and an associated replenishing device.

The xerographic copying apparatus was a Gevafax X-12 apparatus (Gevafax is a registered trademark of AGFA-GEVAERT-Mortsel/Leverkusen) using magnetic brush development. The amount of developer mixture which is present in the container 21 (see FIG. 1) of this apparatus is about 600 grams. It is assumed that for optimum developing conditions, the toner concentration should be 1.7% by weight but that it is permissible to fluctuate between 1.6 and 1.8%. The average weight of toner powder which is consumed in each copying cycle lies in the vicinity of about 60 mg per DIN A4 sheet size.

The graph of FIG. 4 indicates a growth of the toner concentration over a first part of a series of copying cycles and a decrease over the latter part of that series, thereby the initial low concentration is restored. The toner concentration is expressed in % by weight, whereas the number of copies is expressed by n.

In a practical embodiment the amount of toner which is added to the developer mixture amounts to 150 mg per copying cycle. Bearing in mind that about 60 mg is consumed in each copying cycle, this addition represents an increase of 90 mg of toner to the reservoir for each copying cycle over the period considered.

The period A may correspond e.g. with 14 copying cycles. 1.2 g of toner is supplied to the developer mixture over this period in order to restore the 1.8% weight concentration starting from the minimum 1.6% level.

When the 1.8% level is reached the toner replenishing device is switched off and remains so until the lower limit is reached again. At a rate of 60 mg toner for each developing cycle, the switched-off period (period B) corresponds with about 20 copying cycles.

In FIG. 5 the relation between the toner concentration and the output voltage of the rectifier stage of the monitoring apparatus is illustrated. The curve 51 representing a typical relationship has two main characteristics, namely that the operating range is linear and that the curve passes throgh the origin of the graph for carrier only (zero % toner concentration).

Due to the linearity of the system in the region involved the set point (1.7% toner by weight) and its upper and lower limits (1.6 and 1.8%) may be unequivocally determined and in the mean-time a corresponding signal can be generated that is sufficiently great so that its processing causes no particular problems.

In a practical example the value of $V_1$ corresponding to the set point amounts to 7.35 volts whereas the voltages $V_2$ and $V_3$ corresponding respectively to the upper and lower limits of that set point are 7.7 and 7.0 volts respectively.

The fact that the course of the curve 51 passes through the origin makes the calibration of the bridge circuit very easy. Indeed, the absence of toner powder in the developer mixture will give rise to an unequivocal zero value of the output signal.

Simulation of the zero tone concentration condition may also be realized by short-circuiting the poles of the monitoring coil by means of a plate comprising magnetisable material dispersed in e.g. an epoxy resin.

It will be clear to the skilled worker that the calibration described hereinbefore is effective for a given type of carrier material and for a given distance between the magnetic brush 14 and the edge 22. If one of these parameters is changed or modified, another calibration is needed.

It will be clear that the monitoring apparatus can be designed or adjusted for maintaining the toner concentration between different ranges from those above referred to. This may be selected depending on the nature of the originals which are normally copied or on the density of the developed images desired by the customer.

The following are practical characteristics of the monitoring and reference coils:

core type: P 18/11-3HI made by MBLE (Manufacture Belge de Lampes et de Matériel Electronique-Brussels)

number of windings: 250 diameter of the wire: 0.16 mm self-inductance:

2.40 mH approximately at a frequency of 1530 Hz $R_{DC}=8$ Ohms.

It will be understood that an apparatus according to the invention is not limited to the described embodiments.

The analog measuring signal from the bridge circuit incorporating the measuring and the reference coils, may be converted into a digital signal which may be more accurately processed than an analog one. Such processing occurs preferably under the control of a microprocessor which may perform also other tasks in the control of the operation of the copier.

The reference coil 28 may occupy other positions than the one illustrated, provided the conditions of thermal environment and lack of response to the magnetic influence of the developer mixture, are fulfilled.

Finally, the term "copying apparatus" should be broadly interpreted and includes also so-called intelligent printers, wherein the exposure of the xerographic drum occurs by means of a laser, discrete LED's, or the like, but wherein the process of xerographic development is the same as that described hereinbefore.

We claim:

1. Xerographic copying apparatus including an image development station having a developer applicator section in which a free-flowing xerographic developer mixture comprising ferromagnetic particles and non-ferromagnetic toner powder is contacted with the image to be developed for attraction of said toner powder to said image to render the same visible, a toner supply section containing a supply of toner powder, and toner feed means between said sections and operable to deliver additional toner powder from said supply section to said applicator section to replenish the toner powder in said developer mixture, and means for monitoring the concentration of toner powder in said mixture and operating said toner feed means upon significant changes in said concentration, said monitoring means comprising a first induction coil mounted on said applicator section so that the magnetic field of said coil traverses a portion of the developer mixture in said applicator section and its self-inductance changes with changes in the concentration of ferromagnetic particles in said mixture, a second induction coil mounted at said development station so that it is exposed to the same environmental temperature conditions as the first coil but with its magnetic field prevented from traversing said developer mixture, an AC bridge circuit in which first and second induction coils are connected in a first and a second arm of the circuit, an AC source for feeding said bridge circuit, and detecting means for detecting and signalling relative variations in the AC voltages across said first and second induction coils.

2. Apparatus according to claim 1, wherein said second induction coil is mounted on the supply section of the development station.

3. Apparatus according to claim 2, wherein said second induction coil is mounted on a printed circuit board bearing the AC source and the detecting means, and wherein said board is mounted in closely spaced parallel relationship on a wall of said supply section.

4. Apparatus according to claim 1 in which said first and second induction coils have identical characteristics.

5. An apparatus according to claim 1, in which said detecting means comprises a differential amplifier having its inputs connected to said respective induction coils and an associated detector connected to the output of said differential amplifier for producing a DC-voltage proportional to its variation of the AC-voltage across said first induction coil relative to that across the second induction coil.

6. An apparatus according to claim 5, and further comprising trigger means which is responsive to predetermined values of said DC-voltage and which energizes indicator means when a maximum or minimum level of said predetermined values is reached.

7. An apparatus according to claim 1, in which said A-C source for feeding the bridge circuit is an AC-generator with a 3.3 KHz output frequency.

* * * * *